US006626319B2

(12) United States Patent
Miller et al.

(10) Patent No.: US 6,626,319 B2
(45) Date of Patent: Sep. 30, 2003

(54) INTEGRATED TANK ERECTION AND SUPPORT CARRIAGE FOR A SEMI-MEMBRANE LNG TANK

(75) Inventors: Neil M. Miller, Mahwah, NJ (US); David L. Jordan, Pawcatuck, CT (US); Joseph J. Cuneo, Dobbs Ferry, NY (US); Robert D. Goldbuch, Milford, PA (US); Edmund G. Tornay, Wadmalaw, SC (US)

(73) Assignee: Electric Boat Corporation, Groton, CT (US)

( * ) Notice: Subject to any disclaimer, the term of this patent is extended or adjusted under 35 U.S.C. 154(b) by 0 days.

(21) Appl. No.: 10/179,746

(22) Filed: Jun. 25, 2002

(65) Prior Publication Data

US 2003/0057214 A1 Mar. 27, 2003

Related U.S. Application Data

(63) Continuation of application No. 09/873,508, filed on Jun. 4, 2001, now abandoned.

(51) Int. Cl.[7] ..... B65D 90/12

(52) U.S. Cl. ..... 220/560.07; 220/560.08; 220/560.11; 220/560.12; 220/560.15; 220/1.5; 220/562

(58) Field of Search ..... 220/560.07, 560.08, 220/560.11, 560.12, 560.15, 1.5, 562, 567.2, 581, 653, 721, 723; 114/74 R, 74 A, 75, 76

(56) References Cited

U.S. PATENT DOCUMENTS

| | | | | |
|---|---|---|---|---|
| 3,319,431 A | | 5/1967 | Clarke et al. | |
| 3,326,167 A | | 6/1967 | Delli Paoli | |
| 3,337,079 A | | 8/1967 | Clarke et al. | |
| 3,339,782 A | | 9/1967 | Segura et al. | |
| 3,547,302 A | | 12/1970 | Jackson et al. | |
| 3,612,333 A | | 10/1971 | Cowles | |
| 3,719,302 A | | 3/1973 | Hamilton | |
| 3,730,375 A | | 5/1973 | Reed et al. | |
| 3,859,805 A | | 1/1975 | Johnson et al. | |
| 3,861,021 A | | 1/1975 | Yamamoto | |
| 3,941,272 A | | 3/1976 | McLaughlin | |
| 3,968,764 A | | 7/1976 | Kvamsdal et al. | |
| 4,140,073 A | * | 2/1979 | Androulakis | 114/74 A |
| 4,173,936 A | | 11/1979 | Secord et al. | |
| 4,207,827 A | | 6/1980 | Gondouin | |
| 4,345,861 A | | 8/1982 | Aarseth | |
| 4,394,931 A | | 7/1983 | Cotgreave et al. | |
| 4,459,929 A | | 7/1984 | Ffooks | |
| 4,672,906 A | | 6/1987 | Asai | |
| 5,531,178 A | | 7/1996 | Abe et al. | |
| 5,640,918 A | * | 6/1997 | Moe et al. | 114/74 R |
| 5,727,492 A | | 3/1998 | Cuneo et al. | |

* cited by examiner

*Primary Examiner*—Stephen Castellano

(57) ABSTRACT

In the typical embodiment of the invention described in the specification, a prismatic semi-membrane LNG tank is assembled within a support carriage surrounding the top and side walls of the tank and is connected to the tank by a plurality of load bearing insulating support blocks affixed to T-shaped beams on the tank and received in channel shaped members on the support carriage. The tank is assembled within the carriage which is slidably received within a temporary supporting structure and, when the tank has been completed, the integrated carriage and the tank are transferred to the hull of a ship or other permanent support structure. A pipe tower within the tank is affixed to the bottom wall of the tank and slidably connected to a tank dome at the top of the tank which is welded to the top wall of the tank. Stop members limit downward motion of the tank tower with respect to the top wall of the tank.

11 Claims, 7 Drawing Sheets

INTEGRATED TANK ERECTION AND SUPPORT CARRIAGE FOR A SEMI-MEMBRANE LNG TANK

REFERENCE TO RELATED APPLICATION

This application is a continuation of application Ser. No. 09/873,508 filed Jun. 4, 2001, now abandoned.

BACKGROUND OF THE INVENTION

This invention relates to arrangements for constructing semi-membrane tanks for liquefied natural gas (LNG) and the like.

In many conventional manufacturing methods for membrane-type LNG tanks installed in ships or other permanent support structures, partial tank sections are separately manufactured at an off-site location and are transported together with fixtures or assembling devices for separate installation in a ship's cargo hold or other permanent support structure where they are welded to other partial tank sections in sequence until the entire tank has been assembled in the permanent support structure. During installation temporary staging and support bracing is required and access to the space between the outside of the tank and the ship's hull must be provided while the sections are being welded together and tank insulation applied. In addition, internal pumps, piping and tank monitoring systems must be installed before final tank closure and testing. Furthermore, allowance must be made for thermal contraction and expansion of the tank with respect to the ship's hull or permanent support structure.

Such erection and installation of a membrane-type LNG tank structure piece by piece within a ship's hull results in a complicated ship design and an extended shipbuilding schedule. Moreover, when there is a close fit between the LNG tank and the ship's inner hull, access to certain parts of the tank is restricted, and the number of personnel who can be given access to complete the tank erection process is limited. Furthermore, an attempt to build the ship and construct the LNG cargo tank within the ship simultaneously complicates both the ship and tank construction and restricts access to the necessary building resources such as cranes, welding, ventilation and the like for one or the other activity.

Proposals have been made heretofore to construct an entire membrane-type LNG tank outside a vessel or support structure in which it is to be installed and then transfer the completed tank to the vessel but that procedure gives rise to many problems which have not been solved satisfactorily. For example, the prior art does not satisfy the need for complete support of the tank structure while it is being assembled outside the vessel and while it is being transported to and installed in the vessel without requiring removal of temporary support components from the interior of the tank after installation.

The Yamamoto U.S. Pat. No. 3,861,021 discloses a method for constructing a double-membrane type LNG tank in which the entire tank is supported from a platform suspended from a crane during construction so that the tank is not subjected to gravitational effects as a result of its own weight. A temporary internal supporting structure is provided within the tank to support the top and bottom walls of the tank during construction and, as the tank is being installed in a vessel, a vacuum is applied to the space between outer and inner membrane walls of the tank to rigidify them.

The Cuneo et al. U.S. Pat. No. 5,727,492 discloses a membrane-type LNG tank and containment system for installation in an LNG cargo ship which can be constructed either within a ship or other final support structure or outside the ship or final support structure and can thereafter be lowered into place using internal supports to minimize the complexity of external rigging frames.

The Secord et al. U.S. Pat. No. 4,173,936 discloses an arrangement for supporting a membrane-type tank from the hull of a ship using load-bearing insulating blocks.

SUMMARY OF THE INVENTION

Accordingly, it is an object of the present invention to provide an integrated tank erection and support carriage arrangement for semi-membrane prismatic LNG tanks which overcomes disadvantages of the prior art.

Another object of the invention is to provide an integrated tank erection and support carriage arrangement which facilitates manufacture, assembly and installation of semi-membrane prismatic LNG tanks in ships or other permanent support structures.

These and other objects of the invention are attained by providing a carriage arrangement having top and side walls for supporting the top and side walls of a semi-membrane prismatic tank, along with a pipe tower extending into the tank from the support carriage and arranged to support the bottom wall of the tank during construction and installation while allowing for thermal expansion and contraction of the tank in use.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
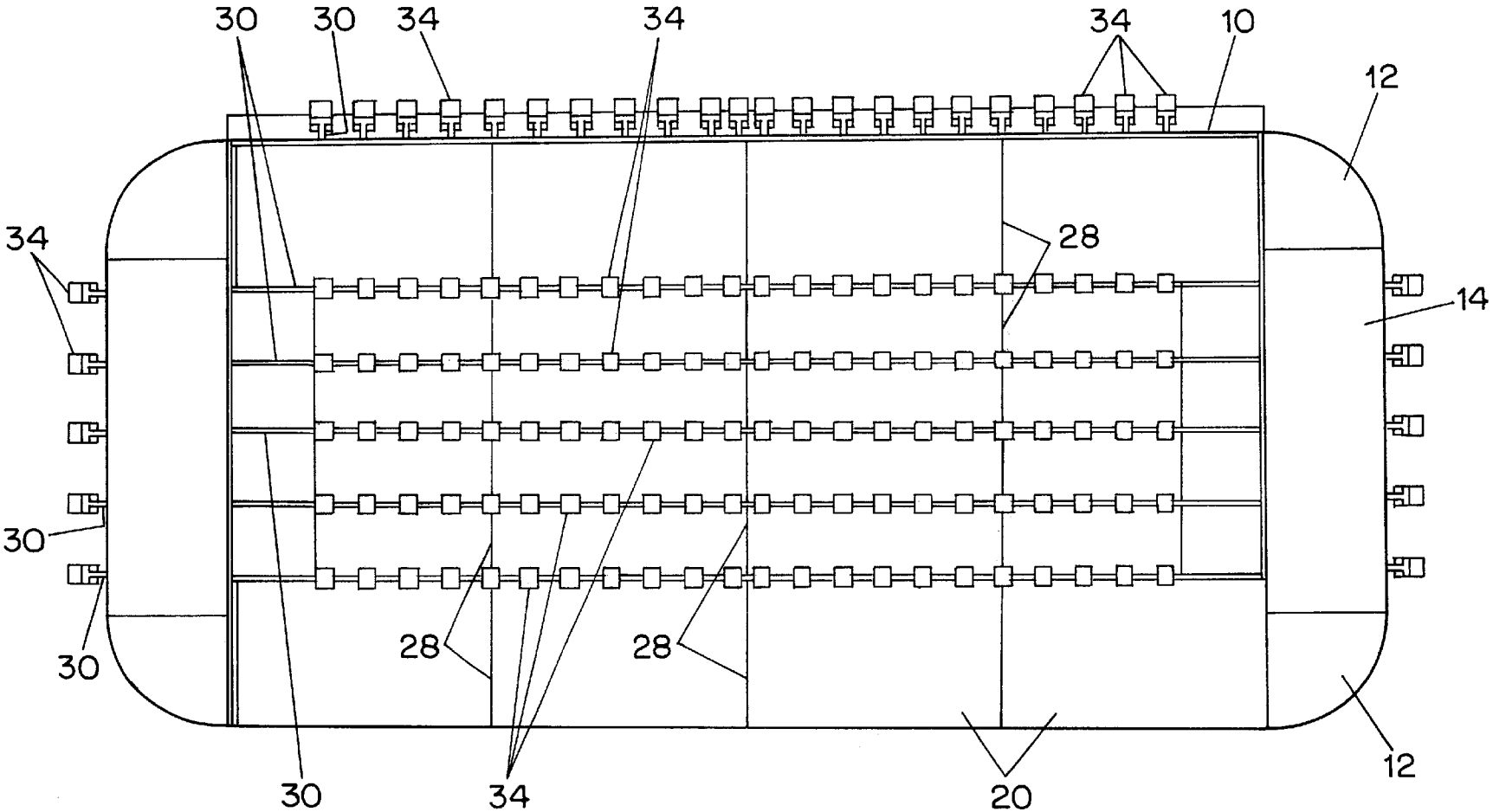
FIG. 1 is a schematic side view illustrating the arrangement of a typical semi-membrane prismatic shaped LNG tank.

A typical semi-membrane prismatic LNG tank 10 is shown in side view in FIG. 1. Such tanks are assembled from a plurality of prefabricated aluminum sheet sections such as the sections 12, 14, and 20, shown in FIG. 1 which are joined along weld lines 28. In most cases the sections have an arcuate shape between the weld lines allowing for some thermal expansion and contraction of the tank as a result of differences in temperature when the tank is empty or is full of liquefied natural gas or the like that must be maintained at a very low temperature.

Such semi-membrane tanks are not self-supporting even when empty and must be provided with support at many points along their outer surface in order to avoid deformation or collapse. In the typical tank illustrated in FIG. 1, T-shaped aluminum stiffening bars 30 are affixed to the tank along weld lines or joints between adjacent arc-shaped segments and a plurality of load-bearing insulating support blocks 34 are provided along the length of each of the stiffening bars 30 to provide support for the tank in the manner described hereinafter.

Figure 2:
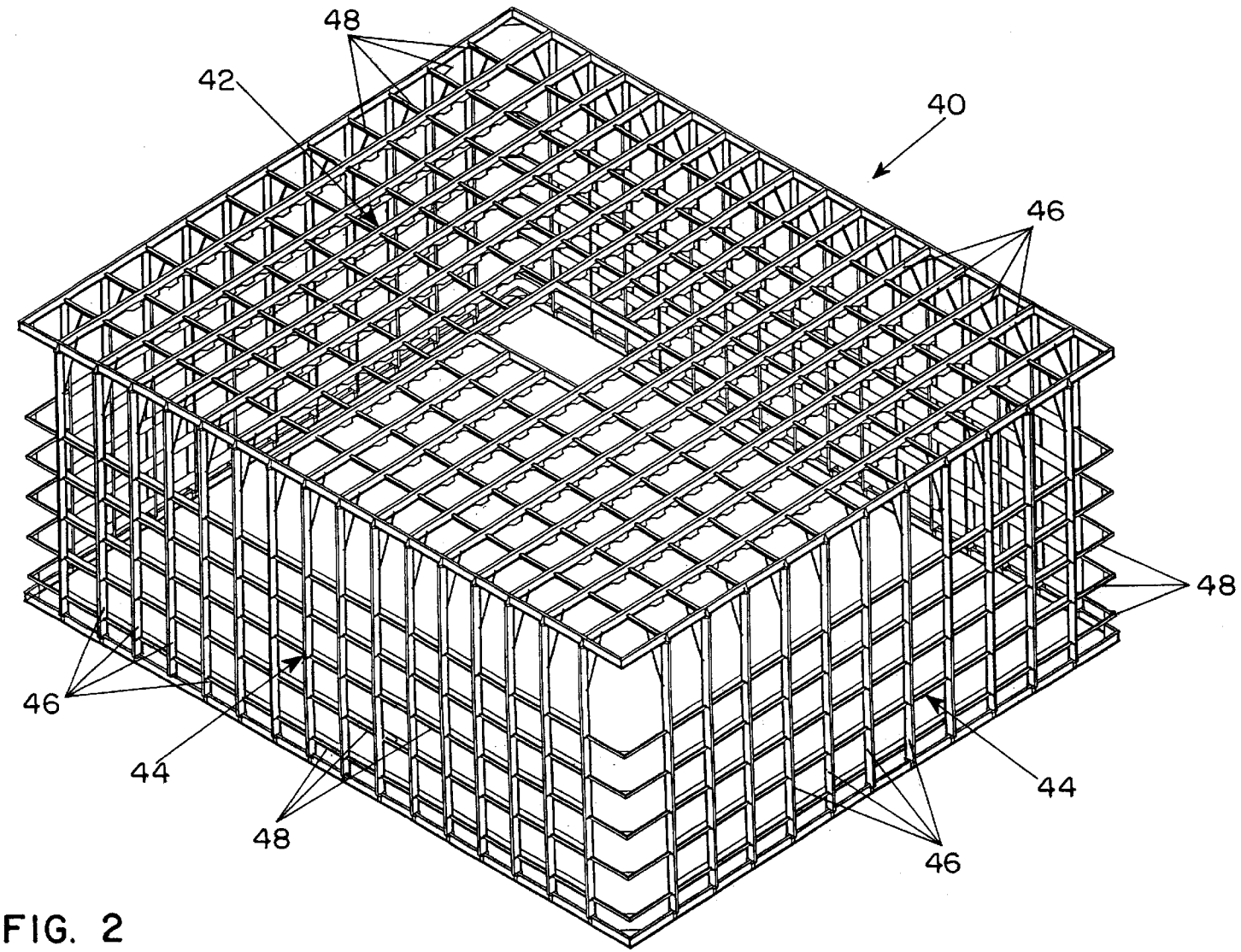
FIG. 2 is a schematic perspective view illustrating a typical carriage arrangement for supporting a semi-membrane-type LNG tank in accordance with the invention.

A representative embodiment of a carriage 40 for supporting a prismatic semi-membrane type LNG tank in accordance with the invention is illustrated in the perspective view of FIG. 2. The carriage 40 has a top frame section 42 and six side frame sections 44 and an open bottom. Each frame section is made of an array of orthogonally oriented beam members 46 and 48 which are welded at their intersections to provide two-dimensional structural grids assembled in a three dimensional carriage form. In the illustrated embodiment the support blocks 34 are attached to the beam members 46 and the dimensions of the open space within the beam members 46 are substantially the same as the outer dimensions of the prismatic semi-membrane tank to be supported by the carriage.

Figure 3:
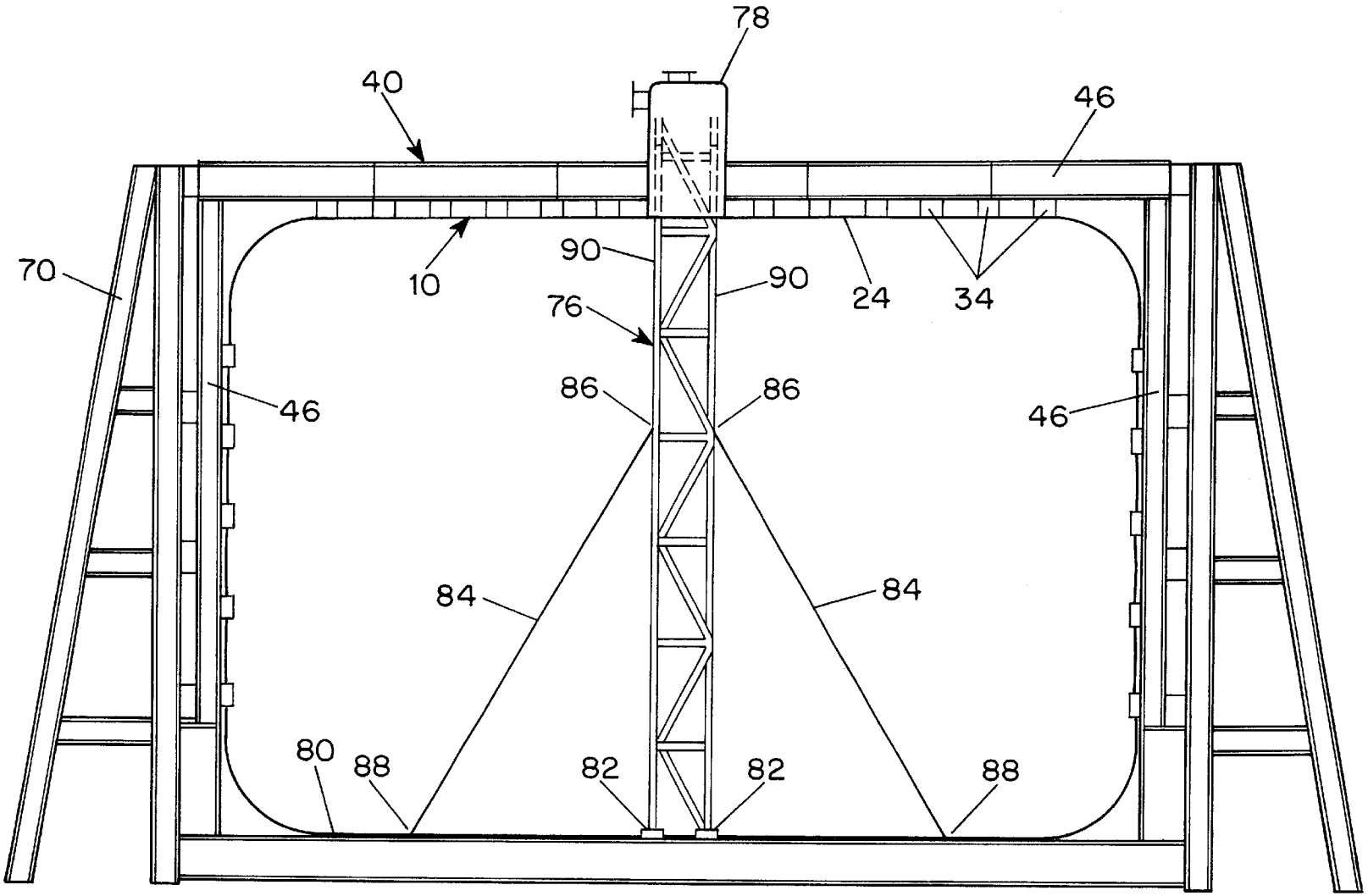
FIG. 3 is a vertical sectional view illustrating a representative embodiment of an integrated tank erection and support carriage arrangement supporting a semi-membrane-type LNG tank in accordance with the invention.
Figure 4:
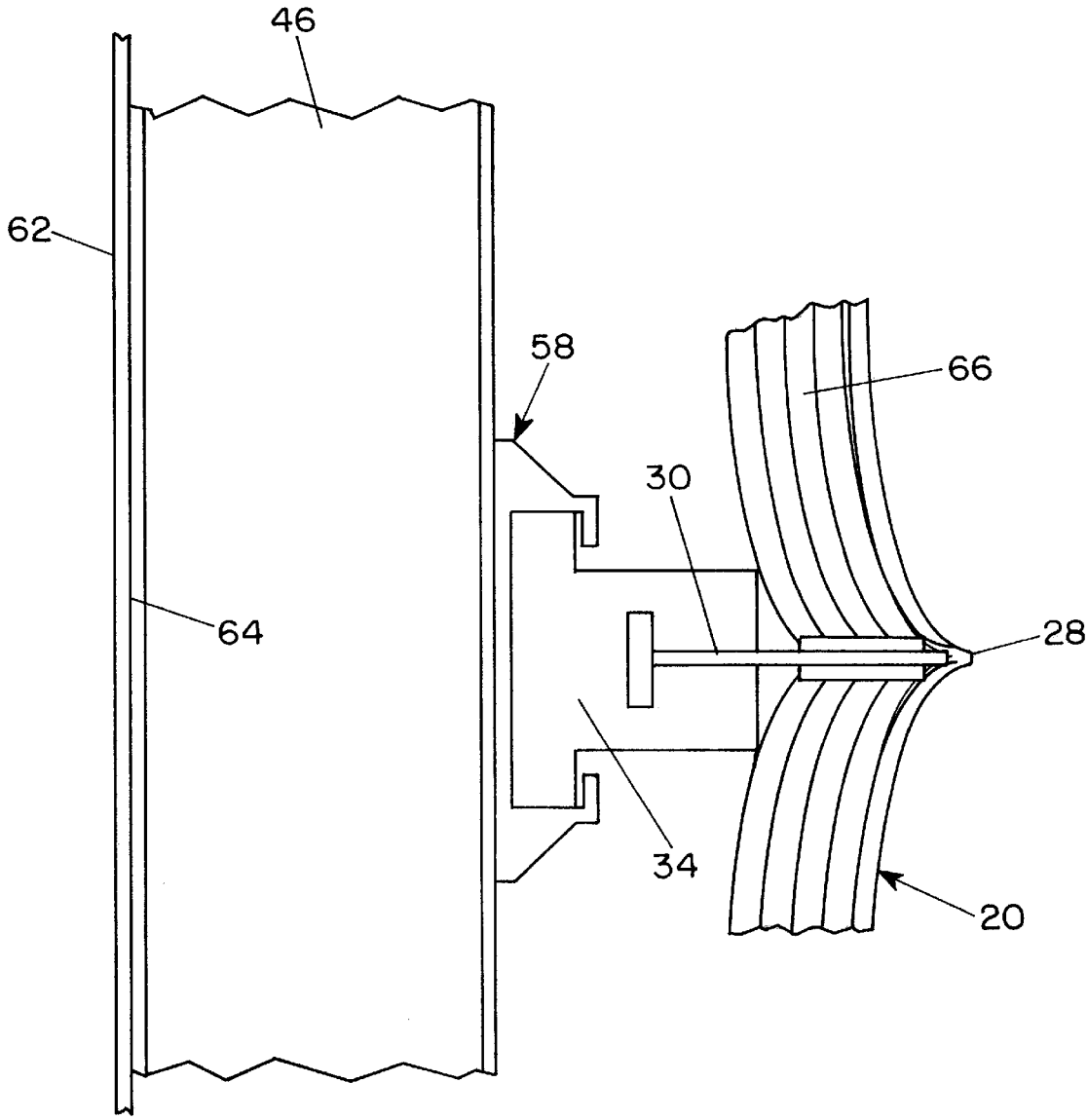
FIG. 4 is a schematic fragmentary side view illustrating a typical support arrangement for supporting the prismatic semi-membrane tank from the carriage after installation within the hull of a ship.
Figure 5:
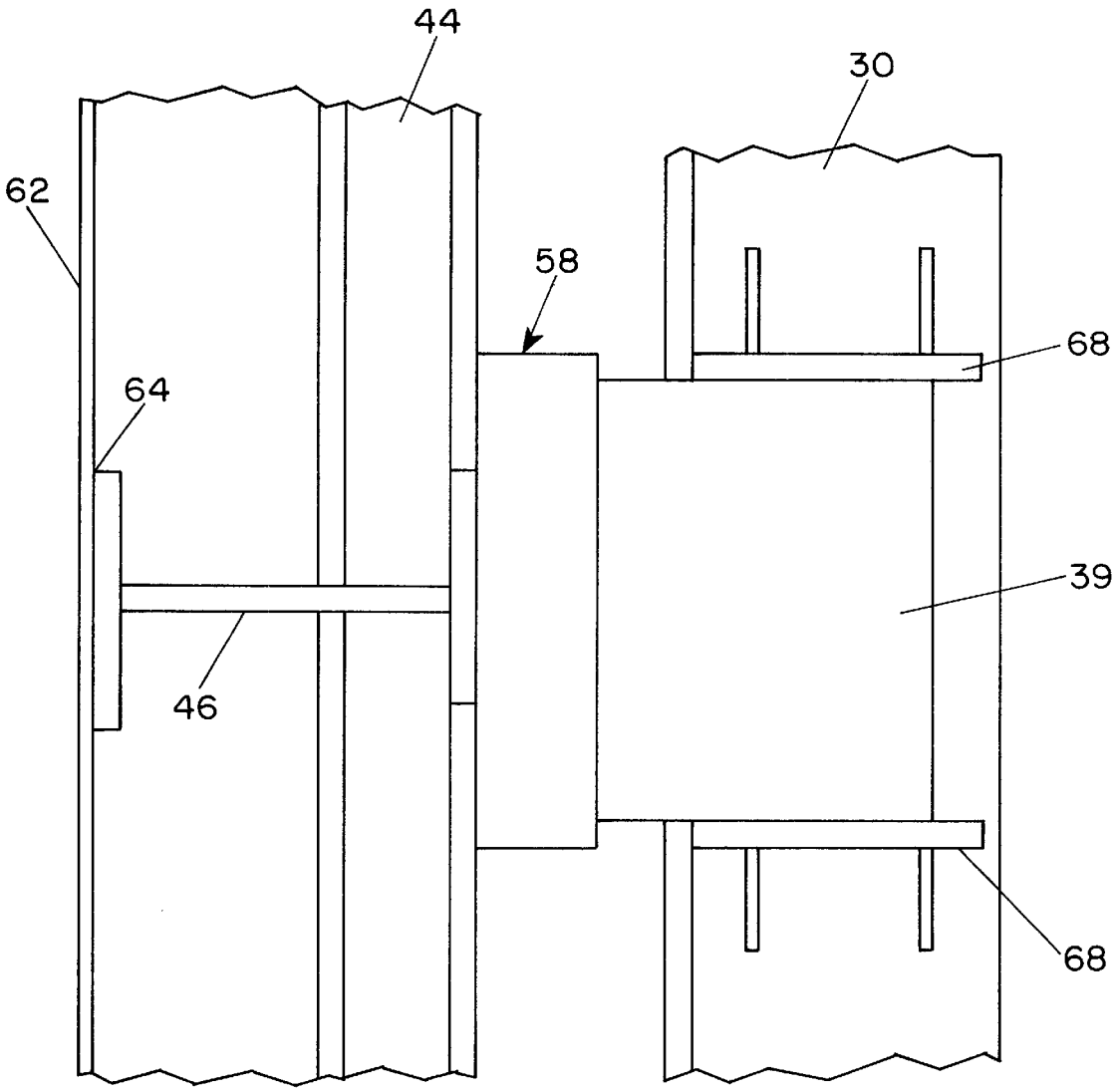
FIG. 5 is a plan view of the support arrangement shown in FIG. 4.

FIG. 3 illustrates a completed semi-membrane prismatic LNG tank 10 supported within a support carriage 40 prior to transfer to the hull of a ship or other permanent support structure in which it is to be installed. FIGS. 4 and 5 are plan and side views, respectively showing the connections between the carriage 40 and the support blocks 34 after the semi-membrane tank 10 has been constructed within the carriage and installed in a ship or other permanent support structure. As shown in FIG. 4, each load-bearing insulating support block 34 has an inner body portion 54 in which the outer edge of a portion of the T-shaped bar 30 is embedded and a vertically enlarged outer portion 56 which is received in a channel member 58 affixed to one of the vertical frame beams 46.

When the carriage 40 and the tank 10 supported by the carriage have been installed in a ship the vertical frame members 46 are welded to an adjacent inner hull member 62 of a ship at weld points 64 as shown in FIGS. 4 and 5. The load-bearing insulating support blocks 34, which may be made of densified wood such as the commercial product know as "Lignostone", provide a high level of insulation between the T-shaped beams 30 and the support members of the carriage structure. In addition, the outer surface of the tank 10 is covered with a thick layer 66, for example 8 or 10 inches, of insulating material such as polyurethane foam to minimize transfer of heat from the carriage members and the hull of the ship to the LNG cargo within the tank.

Because of the arcuate shape of the horizontal wall sections 14 of the tank 10 and the similar arcuate shape of vertically oriented sections 20, thermal expansion and contraction of the tank 10 in both the horizontal and vertical directions can be accommodated to some extent by increases and decreases in the curvature of the arcuate tank section. In addition, some freedom of motion within the channel members 58 is permitted in both the vertical and horizontal direction to accommodate thermal expansion and contraction. To limit such motion in the horizontal direction, stop members 68 are mounted on the T-shaped beam 30 on opposite sides of each support block 34 as shown in FIG. 5.

To provide lateral support for the tank 10 and the carriage 40 during manufacture and assembly, the frame 40 is surrounded by and slidably received within a temporary support structure 70 as shown in FIG. 3. FIG. 3 also illustrates a pipe tower 76 and a tank dome 78 which are installed as part of the completed tank structure prior to transfer of the tank and carriage assembly to the ship or permanent support structure. In order to support the bottom wall 80 of the tank when the tank 10 and carriage 40 are removed from the temporary support structure 70 for transfer to a ship or other permanent support structure, the pipe tower 76 is rigidly affixed to the bottom wall 80 at central locations 82 and temporarily fixed at the tank dome 78. Additional support of the bottom wall 80 is provided by cables 84 extending from upper portions 86 of the pipe tower to locations 88 spaced between the central locations 82 and the side walls of the tank.

Figure 6:
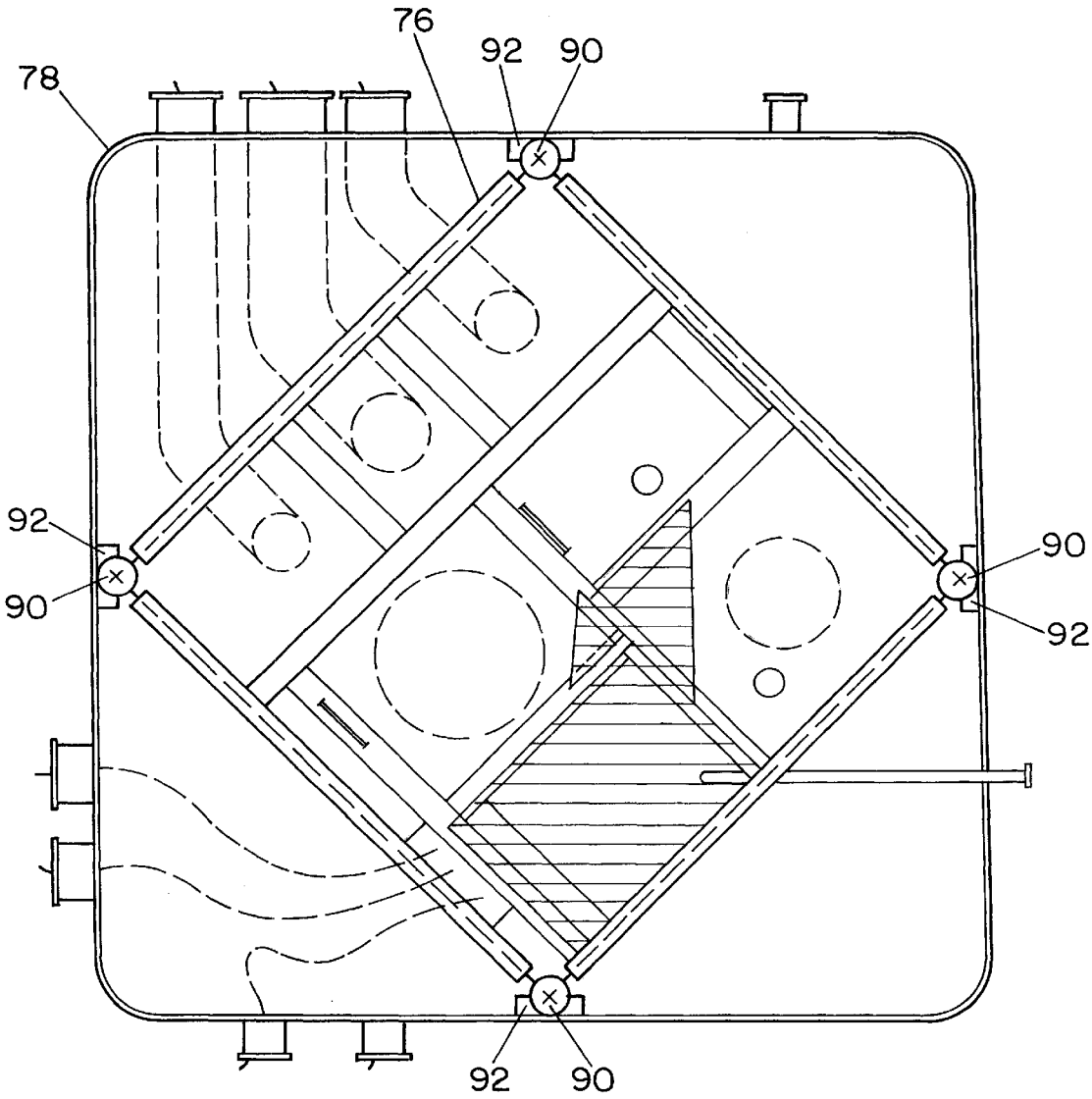
FIG. 6 is a horizontal sectional view illustrating a representative arrangement for supporting a pipe tower within the tank from a dome surrounding the tower.
Figure 7:
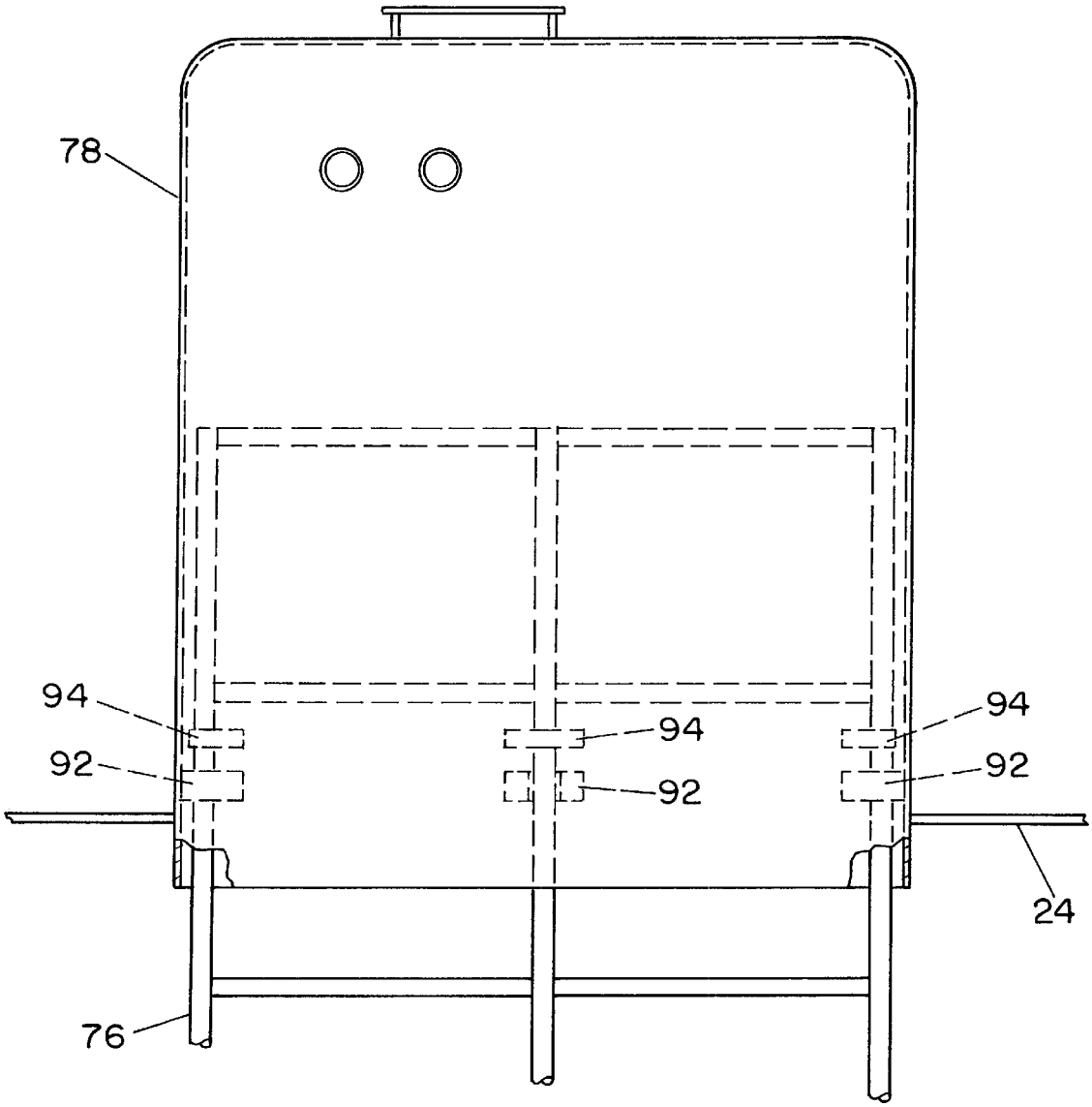
FIG. 7 is a vertical sectional view of the arrangement shown in FIG. 6.

As shown in FIG. 6, each of the vertical beam members 90 of the pipe tower is slidably received in a cradle 92 affixed to the inner wall of the tank dome 78 and as seen in FIG. 7 each vertical beam member 90 is provided with a stop 94 which limits downward motion of the pipe tower 76 with respect to the dome 78. In this way, the weight of the pipe tower 76 and the bottom wall 80 is transferred to the dome 78 from which it is distributed through the top wall 24 of the tank and the associated support blocks 34 to the frame 40 in which those support blocks are mounted. Thus, support for the entire tank 10 including the bottom wall 80 is provided by the support frame 40 without requiring removal of internal supporting structure after the completed tank and carriage assembly has been installed in a vessel or other permanent support structure. Moreover, the cradles 92 allow for relative expansion and contraction of the pipe tower with respect to the carriage.

Although the invention has been described herein with reference to specific embodiments many modifications and variations therein will readily occur to those skilled in the art. Accordingly, all such variations and modifications are included within the intended scope of the invention.

We claim:

1. An integrated tank erection and support structure for a semi-membrane LNG tank comprising:

a semi-membrane tank having a bottom wall, a top wall and a plurality of side walls;

a support carriage surrounding the top wall and at least part of the side walls of the tank;

a plurality of load bearing insulating support blocks connecting the carriage to the side walls and top wall of the tank;

a tank dome rigidly affixed to and projecting upwardly from the top wall of the tank;

a pipe tower extending vertically from and affixed to the bottom wall of the tank and having vertical structural members extending into the tank dome;

a plurality of support members in the tank dome slidably receiving the vertical structural members of the pipe tower; and stop members for limiting downward motion of the vertical structural members of the pipe tower with respect to the top wall of the tank to provide support for the bottom wall of the tank through the pipe tower.

2. An integrated tank erection and support structure in accordance with claim 1 including a plurality of auxiliary support members extending between portions of the bottom wall of the tank and upper portions of the pipe tower.

3. An integrated tank erection and support structure according to claim 2 wherein the plurality of auxiliary support members comprises cables.

4. An integrated tank erection and support structure according to claim 1 including mounts for the load-bearing insulating support blocks arranged to permit limited relative motion between the tank and the support carriage.

5. An integrated tank erection and support structure according to claim 1 wherein the tank includes arcuately shaped sections and T-shaped beams extending from joints between the arcuately shaped sections and wherein the load-bearing insulating support blocks are mounted on the T-shaped beams.

6. An integrated tank erection and support structure according to claim 1 and wherein the mounts for the load-bearing insulating support blocks include channel members affixed to the support carriage providing limited relative motion between the tank and the support carriage.

7. An integrated tank erection and support structure according to claim 1 wherein the vertical structural members of the pipe tower are slidably received in cradles affixed to the tank dome.

8. An integrated tank erection and support structure according to claim 1 including a permanent support structure surrounding and affixed to the support carriage.

9. An integrated tank erection and support structure according to claim 8 wherein the permanent supporting structure comprises a ship's hull.

10. An integrated tank erection and support structure according to claim 6 wherein the mounts provide limited relative motion in both horizontal and vertical directions.

11. An integrated tank erection and support structure according to claim 6 including stop members for limiting relative motion in the horizontal direction.

* * * * *